US011454382B1

(12) United States Patent
Wong et al.

(10) Patent No.: US 11,454,382 B1
(45) Date of Patent: Sep. 27, 2022

(54) LIGHTING DEVICE SYSTEM AND MOVABLE MOUNT FOR SAME

(71) Applicant: Troy-CSL Lighting Inc., City of Industry, CA (US)

(72) Inventors: Calvin Wong, Diamond Bar, CA (US); Jacob Hawkins, Sierra Madre, CA (US)

(73) Assignee: Troy-CSL Lighting Inc., City of Industry, CA (US)

( * ) Notice: Subject to any disclaimer, the term of this patent is extended or adjusted under 35 U.S.C. 154(b) by 0 days.

(21) Appl. No.: 17/220,483

(22) Filed: Apr. 1, 2021

(51) Int. Cl.

| | |
|---|---|
| ***F21V 21/14*** | (2006.01) |
| ***F21V 21/04*** | (2006.01) |
| ***F21V 21/108*** | (2006.01) |
| ***F21V 21/116*** | (2006.01) |

(52) U.S. Cl.
CPC ..... *F21V 21/108* (2013.01); *F21V 21/048* (2013.01); *F21V 21/049* (2013.01); *F21V 21/116* (2013.01); *F21V 21/14* (2013.01)

(58) Field of Classification Search
CPC ..... F21V 21/049
USPC ..... 362/148, 150, 364
See application file for complete search history.

(56) References Cited

U.S. PATENT DOCUMENTS

| | | | | |
|---|---|---|---|---|
| 10,591,146 | B1 * | 3/2020 | Berry | F21V 21/047 |
| 2006/0261235 | A1 * | 11/2006 | Rippel | F21V 21/04 248/343 |
| 2008/0002414 | A1 * | 1/2008 | Miletich | F21S 8/02 362/382 |

* cited by examiner

*Primary Examiner* — Laura K Tso
(74) *Attorney, Agent, or Firm* — Foley & Lardner LLP

(57) ABSTRACT

A moveable mount supports a lighting device assembly and driver electronics. The moveable mount includes a base having a light opening, and a light engine support bracket assembly movably secured to the base. The light engine support bracket is configured to support the lighting device assembly and the driver electronics, for movement relative to the base between a first position in which an optic or a light source of the light engine assembly is aligned with the light opening of the base to direct light through the light opening, and a second position in which the driver electronics is aligned with the light opening of the base.

25 Claims, 8 Drawing Sheets

LIGHTING DEVICE SYSTEM AND MOVABLE MOUNT FOR SAME

BACKGROUND

Modern lighting devices have a light source for emitting light, such as one or more light emitting diodes (LEDs), and connect to one or more drivers having driver electronics for providing power to the LEDs. Certain lighting device systems such as, but not limited to, room or area lighting devices, may be configured to be mounted in an enclosed environment, such as in a housing and/or in a recess of a ceiling, wall or other structure. In those or other contexts, once a lighting device system is installed in the enclosed environment of the housing, ceiling, wall or other structure, it may be difficult to access the lighting device, the driver electronics, or components thereof (for example, to replace, inspect, or service the lighting device, the driver electronics or their components), without removing the lighting device system from its installed position. Accordingly, it can be desirable to provide lighting device system configurations that allow for ease of access to the lighting device, the driver electronics (or components thereof) of an installed system.

In addition, in certain contexts it may be desirable to provide lighting device configurations that allow for adjustment of the direction of light emission from the light source. Such adjustable lighting device configurations can provide advantages including the ability to adjust the direction of light emission into certain areas or onto certain objects in a room or other environment.

Accordingly, lighting device systems of various examples described herein can be configured for ease of access to the lighting device or the driver, while the systems are installed in a housing, ceiling, wall or other structure. In certain examples, the lighting device configurations allow for adjustment of the direction of light emission from the light source, about one or more axis. Certain examples, provide good heat transfer characteristics (to transfer and dissipate heat away from the LED), while also allowing the light emission direction of the lighting device assembly to be selectable or adjustable.

SUMMARY

An example of a lighting device system includes a lighting device assembly having a light source for generating light, and driver electronics connected to provide one or both of a power signal or a control signal to the light source. The system has a base having a light opening. A light engine support bracket assembly is movably secured to the base and configured to support the lighting device assembly and the driver electronics, for movement relative to the base between a first position in which an optic or a light source of the light engine assembly is aligned with the light opening of the base to direct light through the light opening, and a second position in which the driver electronics is aligned with the light opening of the base.

In further examples of the system, the base has at least one guide rail to which the light engine support bracket assembly is slidably connected.

In further examples of the system, the light engine support bracket assembly is moveably secured to the base for movement in a linear direction on the base.

In further examples of the system, the light engine support bracket assembly includes a sliding base plate and at least one of a pivotal or a rotatable support structure to which the light engine assembly is attached for at least one of pivotal or rotational adjustment movement relative to the sliding base plate.

Further examples of the system, include at least one releasable lock member for releasably locking the light engine support bracket assembly in one of the first and the second positions.

In further examples of the system, the lighting device assembly includes a heat sink member, a light source attached to and in thermal communication with the heat sink member, where the light source is arranged to emit light in a first direction.

Further examples of the system include an adjustable support bracket assembly attached to and supporting the lighting device assembly in an orientation that is pivotally adjustable about a first adjustment axis, to allow adjustment of the first direction about a first adjustment axis.

In further examples of the system, the adjustable support bracket assembly further supports the lighting device assembly in an orientation that is rotationally adjustable about a second adjustment axis, to allow adjustment of the first direction about the second adjustment axis, the second adjustment axis being transverse to the first adjustment axis.

In further examples of the system, the second adjustment axis is perpendicular to the first adjustment axis.

Further examples of the system include an adjustable support bracket assembly attached to and supporting the lighting device assembly in an orientation that is rotationally adjustable about an adjustment axis, to allow adjustment of the first direction about the adjustment axis.

Further examples of the system include a driver support bracket attached to the light engine support bracket assembly for movement with the light engine support bracket assembly, wherein the driver electronics comprises a driver electronics module that is received and held by the driver support bracket.

In further examples of the system, the driver support bracket includes a releasable clip that is accessible through the light opening of the base when the light engine support bracket assembly is in the second position.

Further examples of the system include a housing cover secured to the base and enclosing the lighting device assembly and the driver electronics, where the housing cover has one or more openings, and one or more access cover plates that are selectively secured to and removable from the housing cover over the one or more openings in the housing cover.

In further examples of the system, the lighting device assembly includes a selectively removable and attachable optic that is arranged to pass light from the light source.

An example of a moveable mount for supporting a lighting device assembly and driver electronics includes a base having a light opening. A light engine support bracket assembly is movably secured to the base and configured to support the lighting device assembly and the driver electronics, for movement relative to the base between a first position in which an optic or a light source of the light engine assembly is aligned with the light opening of the base to direct light through the light opening, and a second position in which the driver electronics is aligned with the light opening of the base.

In further examples, the movable mount includes a housing cover secured to the base and enclosing the lighting device assembly and the driver electronics.

In further examples, the movable mount includes one or more access cover plates that are selectively secured to and removable from the housing cover over one or more openings in the housing cover.

In further examples, the movable mount includes at least one adjustable arm secured to the base, for mounting the base to a structure.

In further examples of the movable mount, the at least one adjustable arm has a length dimension and is adjustable in length along the length dimension.

In further examples of the movable mount, the base has at least one guide rail to which the light engine support bracket assembly is slidably connected.

In further examples of the movable mount, the light engine support bracket assembly is moveably secured to the base for movement in a linear direction on the base.

In further examples of the movable mount, the light engine support bracket assembly includes a sliding base plate and at least one of a pivotal or a rotatable support structure configured to support the lighting device assembly for at least one of pivotal or rotational adjustment movement relative to the sliding base plate.

In further examples of the movable mount, the lighting device assembly includes a selectively removable and attachable optic that is arranged to pass light from the light source.

In further examples of the movable mount, the light engine support bracket has an opening, notch or protrusion that is engageable through the light opening of the base when the light engine support bracket assembly is in the second position, to selectively apply a force onto the light engine support bracket assembly for moving the light engine support bracket assembly toward the first position.

Further examples relate to a method of making a lighting device system, including providing a lighting device assembly having a light source for generating light and connecting driver electronics to the light source to provide one or both of a power signal or a control signal to the light source. The method also includes providing a base having a light opening and supporting the lighting device assembly and the driver electronics by a light engine support bracket assembly. The method includes moveably securing the light engine support bracket assembly to the base for movement relative to the base between a first position in which an optic or a light source of the lighting device assembly is aligned with the light opening of the base to direct light through the light opening, and a second position in which the driver electronics is aligned with the light opening of the base.

BRIEF DESCRIPTION OF THE DRAWINGS

The above and other aspects and features of the present invention will become more apparent to those skilled in the art from the following detailed description of the example embodiments with reference to the accompanying drawings, in which.

DETAILED DESCRIPTION

Figure 1:
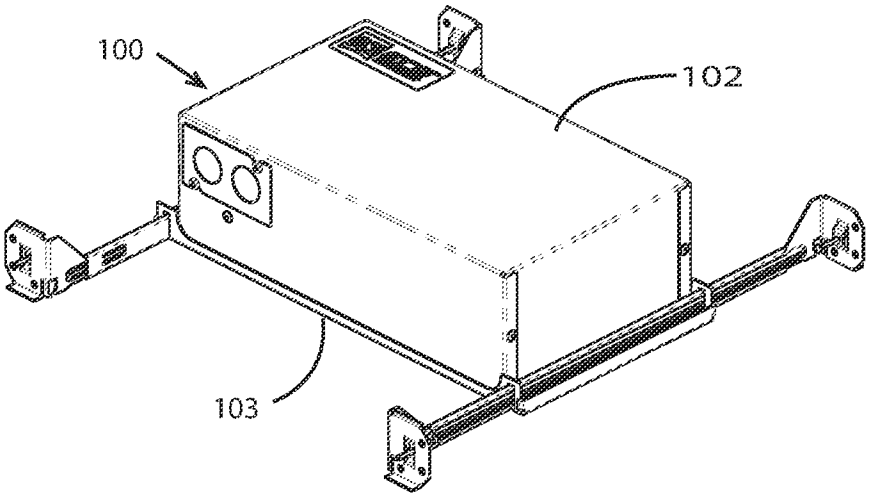
FIG. 1 is a perspective view of an assembled lighting device system according to one example.

Hereinafter, example embodiments will be described in more detail with reference to the accompanying drawings. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof may not be repeated. Further, features or aspects within each example embodiment should typically be considered as available for other similar features or aspects in other example embodiments.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

It will be understood that when an element or layer is referred to as being "on," "connected to," "coupled to," "secured to" or "attached to" another element or feature, it can be directly on, connected to, coupled to, secured to or attached to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprises," "comprising," "includes," and "including," "has," "have," and "having," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

According to various examples described herein, a lighting device system is configured to be installed in a recess or opening provided in a ceiling, wall, outer housing or other object. In some examples, the lighting device system is configured to be installed in an opening to a plenum, duct or attic space of a ceiling, or in an inner wall space in a manner to appear flush or substantially flush with an exposed surface of a ceiling, wall or other object. In other examples, variations of the lighting device system may be configured to be installed in a manner that is not flush with an exposed surface (and, instead, is configured to be recessed or protruding from the exposed surface of a ceiling, wall, outer housing or other object), or is configured to be surface-mounted on the exposed surface of the ceiling, wall, outer housing or other object. In yet other examples, variations of the lighting device system may be configured to be mounted on a support structure (such as, but not limited to a sconce structure, pedestal, shaft or the like). In yet other examples described herein, the lighting device system may be mounted in other suitable locations or environments.

Lighting device systems of various examples described herein can be configured for ease of access to the lighting device (or components thereof) or the driver, while the systems are installed in a housing, ceiling, wall or other structure. By improving the accessibility while the system remains in an installed position, a user may readily access the lighting device or the driver electronics (or both), to replace, inspect, or service the lighting device, the driver electronics or their components, without removing the rest of the lighting device system from its installed position.

The lighting device system includes a lighting device (also referred to as lighting device assembly or light engine assembly) having a light source and an optic member mounted on a heat sink and configured to emit light in a cone or other pattern having a general axis or light emission direction. In examples in which the optic member includes one or more lenses, the axis of the light emission may correspond to an optical axis of the one or more lenses. In other examples, the axis of the light emission may correspond to a center of the light cone or pattern emitted by the light source and optic.

When the lighting device system is mounted in a ceiling, wall, outer housing or other object, or on a support structure, the lighting device assembly may be selectively adjusted, to change, select or adjust the light emission direction (or the direction of the axis of the optic member or the axis of the light cone or other pattern emitted from the optic member). In certain examples, an angle or direction of light emitted from a light source of the lighting device assembly is selectively adjustable about a first adjustment axis. In certain examples, the rotational orientation of the light source (and the radial direction of the light emitted from the light source) is selectively adjustable a second adjustment axis transverse (e.g., perpendicular) to the first adjustment axis. In particular examples, the angle or direction of light emitted from the light source may be selectively adjusted about both the first adjustment axis and the second adjustment axis, to provide a wide range (or a defined range) of selectable light emission directions.

In addition to providing direction adjustment functions, particular examples are configured to also provide sufficient thermal communication between the light source and the heat sink, to dissipate heat and help maintain the temperature of the light source at or below a desired threshold temperature for improved operation.

FIG. 1 is a perspective view of an example of a lighting device system 100 in an assembled state. In the example in FIG. 1, the lighting device system 100 includes a hollow housing cover 102 and a housing base 103. In other examples, the housing cover 102 may be omitted. Accordingly, FIGS. 2 and 3 are perspective views of an assembled lighting device system according to another example having no housing cover, or of the system 100 example of FIG. 1 with the housing cover removed.

Figure 2:
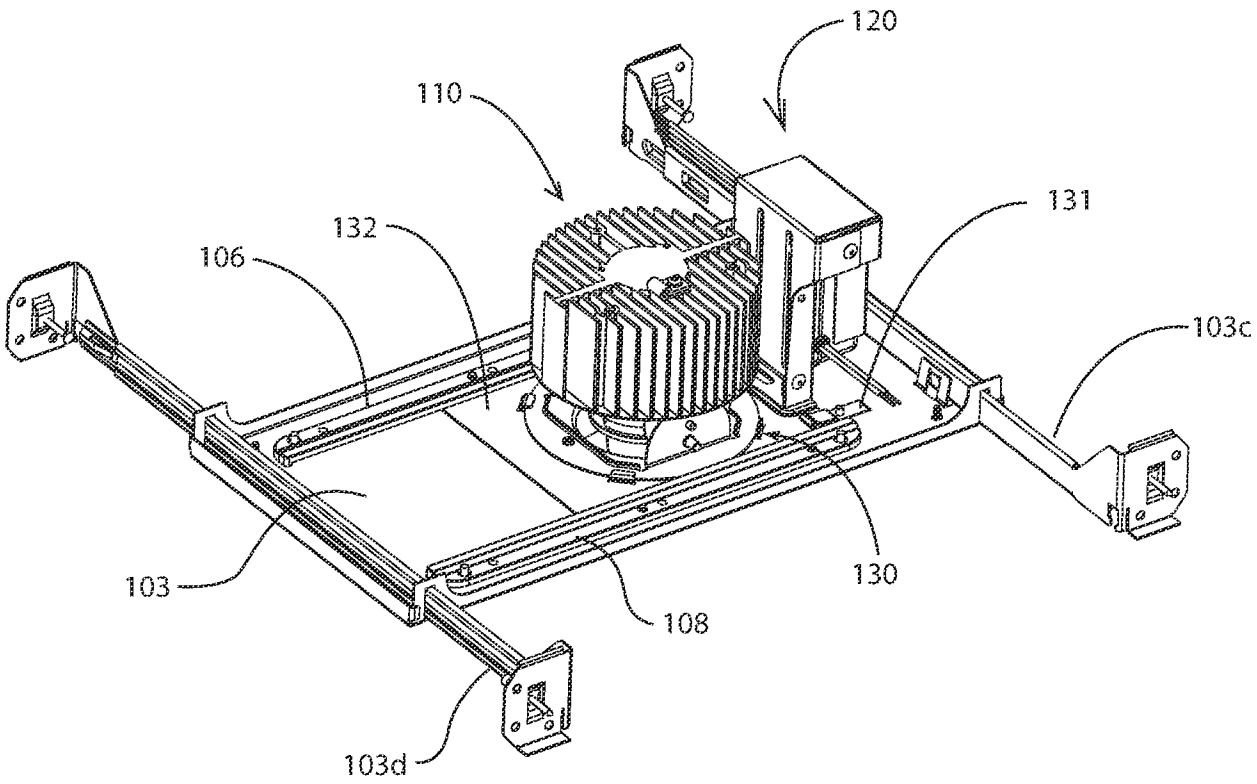
FIG. 2 is a perspective view of an assembled lighting device system according to another example, or of the example of FIG. 1 without a housing cover.
Figure 3:
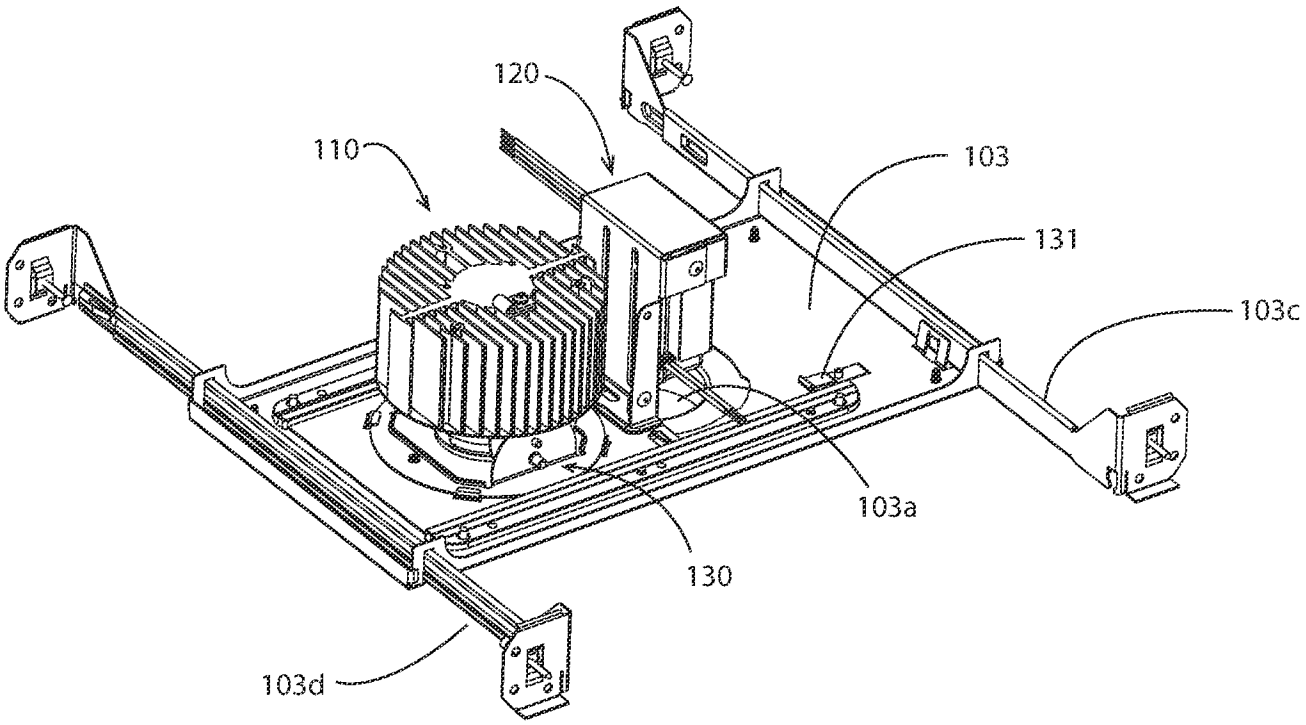
FIG. 3 is another perspective view of the assembled lighting device system according to the example in FIG. 2, or of the example of FIG. 1 without a housing cover.

Components of the lighting device system 100 are supported on the housing base 103, as shown in FIGS. 2 and 3. The base 103 of the lighting device system 100 is configured to be mounted in a ceiling, wall, outer housing or other object, or on a support structure, as described herein, to install the lighting device system 100. Once installed, the housing cover 102 and some or all of the base 103 may be located within a plenum space, an attic space, an inner wall space or another space within a ceiling, wall or other structure. In other examples as described herein, the lighting device system 100 may be installed on a surface of a wall, ceiling or other structure, or in other suitable environments.

Figure 4:
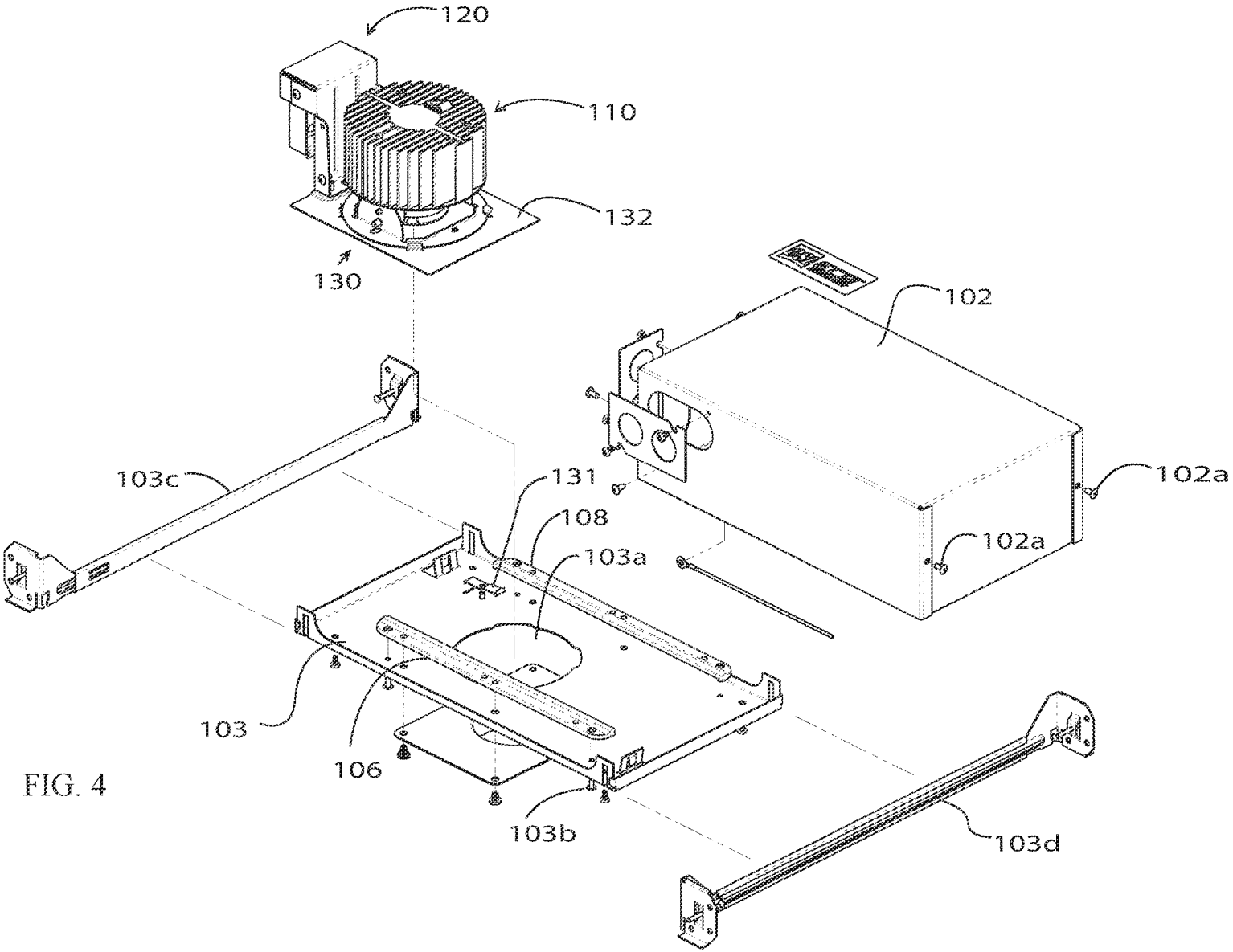
FIG. 4 is a partially exploded view of the lighting device system of FIG. 1.

A partially exploded view of the lighting device system 100 is shown in FIG. 4. The lighting device system 100 includes a light engine assembly 110, a driver assembly 120 and a light engine support bracket assembly 130, shown in an assembled state in FIG. 4 and shown in an exploded view in in FIG. 5.

As discussed herein, the light engine support bracket assembly 130 supports the light engine assembly 110 and the driver assembly 120 on the housing base 103, for movement on (and relative to) the housing base 103 between a first position and a second position. An example of the light engine support bracket assembly 130 (supporting the light engine assembly 110 and the driver assembly 120) in the first position is shown in FIG. 2, and in the second position is shown in FIG. 3. In other examples, the first and second positions may be provided at other locations on the base 103, relative to the locations shown in FIGS. 2 and 3.

In the first position of the bracket assembly 130 (shown in FIG. 2), the light engine assembly 110 is aligned with an opening 103*a* in the housing base 103, to direct light through the light opening. Also, in certain examples, when the light engine assembly 110 is aligned with the opening 103*a* in the base 103, the light engine assembly (or components thereof) are accessible through the opening 103*a*, for example, for inspection, replacement or servicing.

In the second position of the bracket assembly 130 (shown in FIG. 3), the light engine assembly 110 is out of alignment with the opening 103*a* and, instead, the driver assembly 120 is aligned with the light opening 103*a* in the housing base 103, to allow access to the driver assembly 120 (or components thereof) through the opening 103*a*, for example, for inspection, replacement or servicing). Accordingly, while the lighting device system 100 remains installed in a ceiling, wall, or other structure or environment, the bracket assembly 130 may be selectively moved between the first and second positions (FIGS. 2 and 3), to selectively align the light engine assembly 110 or the driver assembly 120 with the opening 103*a*, without removing the base 103 or the housing cover 102 of the lighting device system 100 from its installed state. In particular examples, the base 103 may include one or more releasable lock members 131 (such as, but not limited to releasable clips, stops or other suitable mechanisms) that releasably engage and retain the bracket assembly 130 in the first position. In other examples, the base 103 may include one or more releasable lock members (such as, but not limited to releasable clips, stops or other suitable mechanisms) that releasably engage and retain the bracket assembly 130 in the second position. In further examples, the base 103 may include two or more releasable lock members (such as, but not limited to releasable clips, stops or other suitable mechanisms) that releasably engage and retain the bracket assembly 130 in two or more selectable positions, including the first position and the second position. In particular examples, the releasable lock member(s) 131 hold and retain the bracket assembly 130 in the first position, the second position, or either position, with a retention force that can be overcome by manual force of a typical user, to release the bracket assembly 130 from the lock member 131 and move the bracket assembly 130 between the first and second positions.

In examples such as shown in FIGS. 1 and 4, in which the lighting device system 100 includes a housing cover 102, the housing cover 102 is configured to engage and be supported by the housing base 103, and to cover components supported on the housing base 103. The housing cover 102 may include a hollow structure having one or more side walls and a top wall, and an open bottom side (the side facing downward in FIGS. 1 and 4.) In the example in FIGS. 1 and 4, the housing cover 102 has a rectangular-box shape. In other examples, the housing cover 102 may have a square-box shape, a cylindrical shape or another suitable shape.

The housing base 103 may be a plate-like structure having a shape that corresponds to the shape of the housing cover 102. Accordingly, in the example in FIGS. 1-4, the housing base 103 has a rectangular, plate-like shape. In other examples, the housing base 103 may have other suitable shapes including, but not limited to square plate-like shapes, or round disc-like shapes. The housing base 103 has an opening 103*a* and may include side walls 103*b*. The housing cover 102 is received between the side walls 103*b*, to hold the cover 102 on the base 103.

In the example in FIG. 4, the side walls 103*b* include apertures for receiving one or more fasteners (not shown) to attach the housing cover 102 to the base 103. Accordingly, in those or other examples, during either manufacture, assembly or installation of the lighting device system 100, the housing cover 102 may be attached to the housing base 103 by one or more of the fasteners such as, but not limited to one or more screws, bolts or other threaded fasteners, clips, friction fitting, adhesives, welding, heat staking, combinations thereof, or the like. The housing cover 102 and the housing base 103 are configured to enclose components of the lighting device system 100 (including the light engine assembly 110, the driver assembly 120 and the light engine support bracket assembly 130, when the housing cover 102 is attached to the housing base 103.

The base 103 may include or operate with one or more adjustable arms (where two arms 103*c* and 103*d* are shown in the example in FIGS. 1-4), for mounting the base 103 in an installation environment, as described herein. The arms 103*c* and 103*d* are retained on the base 103 by any suitable retention structure. In the illustrated example, the arms 103*c* and 103*d* are retained on the base 103 by extending through slots or openings in the side walls 103*b* of the base 103, as shown in FIG. 1. Each arm 103*c* and 103*d* has a length dimension between two end portions that are configured to engage and be secured to supporting structure in an installation environment as described below. In particular examples, each arm 103*c* and 103*d* is adjustable in its length dimension. In the example in FIG. 4, each arm has two sections that slide or move in a telescoping manner relative to each other, to selectively extend or reduce its length dimension. The adjustable length arms 103*c* and 103*d* can help simplify installation operations by allowing the arms to adjust to fit a desired space and engage supporting structure within various installation environments.

The housing cover 102 and the housing base 103 may be made of any suitable rigid material or materials such as, but not limited to metal, plastic, ceramic, composite material, wood, or other suitable material. In particular examples, the housing cover 102 and the housing base 103 are each made of a rigid metal or other materials having good heat conductivity, to help dissipate heat generated by components within the housing cover 102, or good thermal insulating capabilities to thermally isolate the components within the housing cover 102 from the installation environment.

In certain examples, the housing cover 102 and the housing base 103 are each made of sheet metal materials that are cut into a pattern and, then, bent into the shape of the cover 102 or of the base 103. The housing cover 102 may include one or more fasteners 102*a* to help secure the bent sheet material into its bent shape. In other examples, the housing cover 102 or the housing base 103 (or both) may be made by other suitable manufacturing methods including, but not limited to constructing from separate wall panels, molding, machining, or combinations thereof.

The lighting device system 100 includes a mounting structure that mounts the light engine support bracket assembly 130 to the base 103, and allows the bracket assembly 130 to move on (and relative to) the base 103 between first and second positions (such as shown in FIGS. 2 and 3, respectively). In the example in FIGS. 1-5, the mounting structure includes a rail structure on which the light engine support bracket assembly 130 is slidable in a linear direction (while supporting the light engine assembly 110 and the driver assembly 120) between the first and second positions shown in FIGS. 2 and 3, respectively. In other examples, the mounting structure may include other suitable mechanisms that mount the light engine support bracket assembly 130 to the base 103, for movement on (and relative to) the base 103 including, but not limited to curved rails for sliding movement of the bracket assembly 130 along a curved path, a pivotal joint for moving the bracket assembly 130 rotationally, one or more wheels or rollers on which the bracket assembly 30 moves, or the like.

In the example in FIGS. 1-5, the mounting structure includes a rail structure having two parallel, linear rails 106 and 108 on the base 103, for engaging and holding the bracket assembly 130 for movement. Each rail 106 and 108 has a linear dimension and may be made of any suitably rigid material, such as, but not limited to metal, plastic, ceramic, composite material, combinations thereof, or the like. In particular examples, the rails 106 and 108 are made of a metal or other material having good thermal conductivity characteristics, and are in thermal contact with the base 103, to help conduct heat from the bracket assembly 130 to the base 103 (or to the base 103 and the housing cover 102) for dissipation to an external environment.

Figure 6:
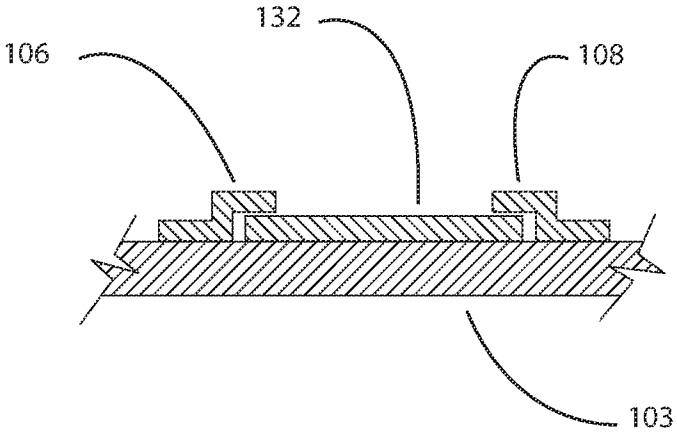
FIG. 6 is a cross-section diagram of an example of a rail structure for a lighting device system according to FIGS. 1 and 2.

FIG. 6 is a cross-sectional representation of an example of the rails 106 and 108 on the base 103 (with the cross-section taken perpendicular to the linear dimension of the rails), and shows the rails engaging a base plate 132 of the bracket assembly 130. In that example, each rail 106 or 108 has a stepped or shaped configuration to retain the base plate 132 of the bracket assembly 130 between a portion of the rail and the base 103, while allowing the base plate 132 of the bracket assembly 130 to slide in the linear direction of the rail. In other examples, the rails 106 and 108 may have other suitable configurations for engaging the bracket assembly 130 for movement relative on the base 103. In other examples, the rail structure may include only one rail, or more than two rails that engage the bracket assembly 130.

Figure 5:
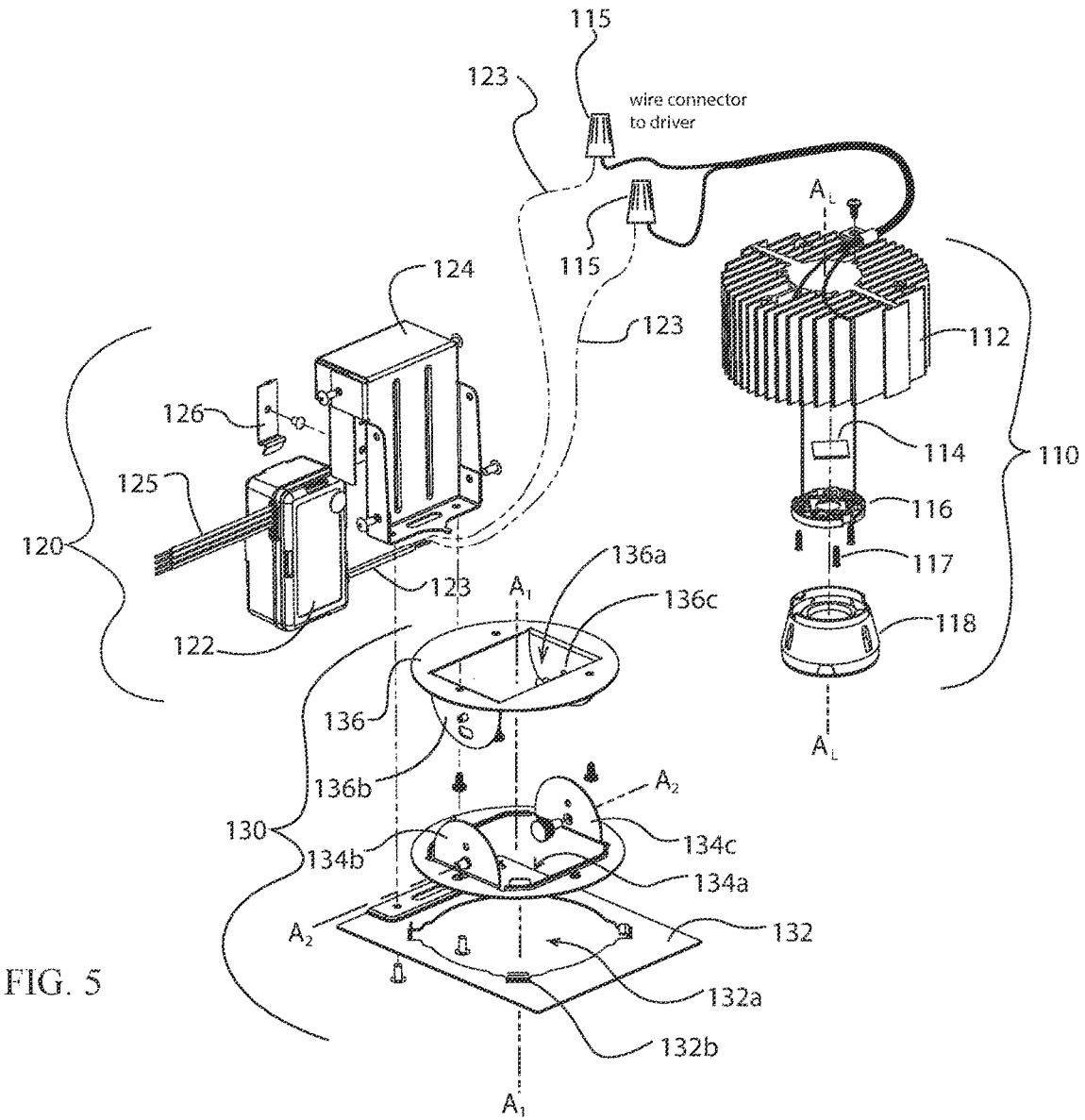
FIG. 5 is a partially exploded view of the lighting device assembly, the light engine support bracket assembly and the driver assembly of the example in FIG. 2.

The example of the light engine support bracket assembly 130 shown in FIG. 5 includes the sliding base plate 132, a first bracket member 134 and a second bracket member 136. The second bracket member 136 is attached to and pivotally supported on the first bracket member 134. The first bracket member 134 is attached to and rotationally supported on the sliding base plate 132. As discussed above and shown in FIG. 6, the sliding base plate 132 is configured to engage and be retained by the rails 106 and 108 for sliding movement in the linear direction of the rails, between a first position and a second position (e.g., positions as shown in FIGS. 2 and 3, respectively). In particular examples, the base 103 may include one or more releasable lock members 131 that releasably engage and retain the sliding base plate 132 in the first position, the second position, or either position, as described above.

In the example in FIGS. 5 and 6, the sliding base plate 132 has a generally rectangular plate-like shape, with a central opening 132*a*, a first side edge portion (on the left side of FIG. 6) that is arranged between a portion of the rail 106 and the base 103, and a second side edge portion (on the right side of FIG. 6) that is arranged between a portion of the rail 108 and the base 103. The rails 106 and 108 retain the base plate 132 on the base 103, while allowing the base plate 132 to slide on the base 103 along the parallel length dimensions of the rails 106 and 108.

The first bracket member 134 is attached to the base plate 132, and moves with the base plate 132, as the base plate slides along the rails 106 and 108. In some examples, the first bracket member 134 may be secured to or formed integral with the base plate 132 and is fixed relative to the base plate. However, in other preferred examples, the first bracket member 134 is attached to the base plate 132, and is rotationally moveable relative to the base plate 132 about an axis $A_1$ of the bracket assembly 130. Rotational movement of the base plate 132 about the axis $A_1$ allows the light engine assembly 110 to be rotationally adjusted, to adjust the direction of light (or an axis of a light pattern or cone) emitted by the light engine assembly about a first axis (i.e., the axis $A_1$).

In the example in FIG. 5, the opening 132*a* in the base plate 132 is round and centered on the axis $A_1$. In addition, the first bracket member 134 has a round, plate-like shape centered on the axis $A_1$, and has a central opening 134*a* aligned with the central opening 132*a* of the base plate. The first bracket member 134 has an outer diameter that is larger than the outer diameter of the opening 132*a* in the base plate 132. The first bracket member 134 is arranged on the base plate 132, over the opening 132*a* of the base plate. However, because the diameter of the first bracket member 134 is larger than the diameter of the opening 132*a* in the base plate 132, the first bracket member 134 is held on the base plate 132, over the opening 132*a*, but does not pass through the opening 132*a*.

One or more (or a plurality of) tabs or other protrusions 132*b* may be provided around the opening 132*a* in the base plate 132, to retain the first bracket member 134 from lateral and linear movement relative to the base plate 132. The example in FIG. 5 includes four tabs 132*b* (where one of the tabs is out of view behind the base plate 132). In certain examples, one or more of the tabs 132*b* may have an L-shaped configuration, such that a portion of the tab extends over an edge portion of the first bracket member 134, as shown in FIG. 4. The portion of the tab extending over the edge portion of the first bracket member 134 may help to retain the first bracket member 134 on the base plate 132 and inhibit linear movement of the first bracket member 134 in the direction of the axis $A_1$, away from the base plate 132. However, the tabs allow the first bracket member 134 to rotate about the axis $A_1$ relative to the base plate 132. As described herein, rotational movement of the base plate 132 about the axis $A_1$ allows the light engine assembly 110 to be rotationally adjusted about that axis.

In certain examples one or more (such as, but not limited to two) of the tabs 132*b* may have an L-shaped configuration, while one or more (such as, but not limited to two) of the tabs 132*b* may have a straight or planar configuration, to allow selective manual removal and replacement of the first bracket member 134 from the base plate 132. In certain examples, as shown in FIG. 5, the tabs 132*b* may be formed by cutting tab shapes from the edge of the opening 132*a*, and bending the tabs (upward in the orientation of FIG. 5) to protrude from the rest of the base plate 132. In other examples, the tabs or protrusions 132*b* are provided by molding, machining or attaching the tabs or protrusions on the rest of the base plate 132.

The first bracket member 134 includes first and second protruding portions or flanges 134*b* and 134*c* that extend in a direction away from the base plate 132 and toward the second bracket member 136 (i.e., the upward in the orientation of FIG. 5). The second bracket member 136 has a plate-like shape and includes a central opening 136*a* and protruding portions or flanges 136*b* and 136*c* extending in a direction toward the first bracket member 134 (i.e., the downward in the orientation of FIG. 5). The flanges 134*b* and 134*c* of the first bracket member 134 pivotally attach to the flanges 136*b* and 136*c*, respectively, of the second bracket member 136, to allow pivotal movement of the second bracket member 136 about a second axis $A_2$, relative to the first bracket member 134.

More specifically, the bracket assembly 130 includes pivot joints 138*a* and 138*b* that connect the flanges for pivotal motion. In certain examples, each pivot joint includes a pivot pin, bolt or axle extending through or from the flanges. In the example of FIG. 5, the pivot pin 138*a* extends from or through one of the flanges 134*b* and 136*b*, and extends through an opening in other one of those flanges, to pivotally connect the flange 136*b* to the flange 134*b*. Similarly, the pivot pin 138*b* extends from one of the flange 134*c* and 136*c*, and extends through an opening in the other one of those flanges, to pivotally connect the flange 136*c* to the flange 134*c*.

The pivot pins 138*a* and 138*b* are aligned on the second axis $A_2$, and secure the second bracket member 136 to the first bracket 134, while allowing selective pivotal movement or adjustment of the second bracket member 136 about the second axis $A_2$ relative to the first bracket member 134. In particular examples, the connected flanges on the first and second bracket members 134 and 136 engage and abut in contact with each other for thermal communication (to transfer heat from the second bracket member 136 to the first bracket member 134). In those or other examples, the engagement of the flanges provides frictional resistance to pivotal movement, sufficient to hold and maintain the adjusted, pivotal position of the second bracket member 136 (and the light engine assembly 110) relative to the first bracket member 134, against gravity. However, the frictional resistance may be overcome by manual force applied to pivotally move the second bracket member 136 about the second axis $A_2$.

Pivotal movement of the second bracket member 136 about the second axis $A_2$ allows the light engine assembly 110 to be pivotally adjusted, to adjust the direction of light (or an axis of a light pattern or cone) emitted by the light engine assembly about the second axis $A_2$. In other examples, other suitable connection structure for pivotally connecting the flanges of the first and second bracket members 134 and 136 may be employed including, but not limited to a structure having a single pivot axel extending along the second axis $A_2$, through all four flanges.

Accordingly, the bracket assembly 130 is configured to allow rotational movement or adjustment of the first bracket member 134 (and the light engine assembly 110) about the first axis $A_1$, and pivotal movement or adjustment of the second bracket member 136 about the second axis $A_2$. The combination of those adjustment axes can provide a large range of adjustable directions of light from the light engine assembly 110. In other examples, the rotational adjustment capability may be omitted and the first bracket member 134 may be fixed to or integral with the base plate 132 (in a non-pivotal manner). In yet other examples, the pivotal adjustment capability may be omitted and the first and second bracket members 134 and 136 may be connected to each other in a fixed (non-pivotal) manner or may be formed integral with each other.

When the second bracket member 136 is attached to the first bracket member 134, and the first bracket member 134 is attached to the base plate 132, the openings 136*a*, 134*a* and 132*a* in the bracket members and the base plate align with each other. As described below, the aligned openings 136*a*, 134*a* and 132*a* provide a passage through which light from the light engine assembly 110 may pass. The aligned openings 136*a*, 134*a* and 132*a* also align with the light opening 103*a* in the base 103, when the bracket assembly 130 is in the first position (e.g., the position in FIG. 2).

The base plate 132, the first bracket member 134 and the second bracket member 136 may each be made of any suitably rigid material or materials, such as, but not limited to metal, plastic, ceramic, composite material, combinations thereof, or the like. In particular examples, those features are made of a metal or other material having good thermal conductivity characteristics, and are in thermal contact with each other and with a heat sink member of the light engine assembly 110, to help conduct heat from the light engine assembly 110 to the rails 103 and 106 and the base 103 for dissipation to an external environment.

The bracket assembly 130 (including the base plate 132 and the first and second bracket members 134 and 136) hold and support the light engine assembly 110 and the driver assembly 120. In the example in FIGS. 4 and 5, the light engine assembly 110 includes a heat sink member 112, a light source 114, a light source mounting frame 116 and an optic member 118.

The heat sink member 112 may be composed of a body of generally rigid material having good thermal conductivity characteristics to efficiently conduct heat. In certain examples, the heat sink member 112 includes a single, unitary block or plate of aluminum, copper or other metal having significant or substantially great heat conduction capabilities. In certain examples, the heat sink 112 may be formed (e.g., cast or forged) from solid aluminum. However, in other examples, the heat sink member 112 may be composed of other materials or of multiple parts that are fixed or connected together to form a heat sink structure as described herein.

In the illustrated example, the body of the heat sink member 112 has a generally cylindrical shape with fins for further heat dissipation. In other examples, the heat sink member body may have a cuboid, block or brick shape, or other shape, with or without fins. The shape of the body of the heat sink member 112 defines an axis $A_L$ (which may correspond to an axis of a cone or pattern of light emitted from the light source 114).

The heat sink member 112 includes a light-source mounting surface (a surface facing downward in FIG. 5) on which a light source 114 is mounted. The light source 114 is arranged to emit light outward from the heat sink member 112, toward the optic member 118. The light source 114 and the optic member 118 are configured to emit light in a cone or other pattern having an axial direction or light emission direction.

The heat sink member 112 may include one or more passages through which one or more electrical wires or other electrical conductors 113 extend (as represented by a two conductor cable in FIG. 5. The one or more electrical wires or other conductors 113 are configured to connect the light source 114 to driver electronics in the driver assembly 120, through one or more electrical connectors 115 (two shown in FIG. 5 for the two conductors of the cable 113). In particular examples, the one or more electrical connectors 115 are selectively connectable and releasable, to allow the driver electronics to be selectively connected or disconnected from the light source 114 (for example, to install, remove, or replace driver electronics or a light source 114 in the lighting device system 100). In those examples, the one or more electrical connectors may include but are not limited to electrical plug and socket connectors (male/female connectors), wire nuts, lever nuts push in wire connectors, or the like.

The light source 114 may include any suitable light emitting device or devices. In particular examples, the light source 114 includes one or more LEDs or other light source that generates heat during operation. In such examples, the one or more LEDs (or other light source) may include or be mounted on a circuit board or other support structure. As described herein, the heat sink member 112 is configured to conduct and dissipate heat away from the light source 114, which can significantly improve the efficiency and light output of the one or more LEDs (or other heat-generating light sources). While particular examples described herein include a light source 114 having one or more LEDs, other examples may include other suitable light sources such as, but not limited to one or more halogen, halide, fluorescent, or incandescent light sources, or other electrical discharge or electroluminescence device, or the like.

In particular examples, the light source 114 is secured to and mounted in thermal communication with the light-source mounting surface of the heat sink member 112, such that the heat sink member 112 may efficiently receive and conduct heat from the light source 114. In certain examples, the heat sink member 112 may be in direct contact with the light source 114, to efficiently transfer heat away from the light source 114. In certain examples in which the light source 114 includes a circuit board on which one or more light emitting devices are mounted, the circuit board may be mounted in direct contact with a surface of the heat sink member 112, to enhance the ability to transfer heat from the circuit board (or components on the circuit board) to the heat sink member 112.

In certain examples, the light source mounting frame 116 is provided to secure the light source 114 to the heat sink member 112. The mounting frame 116 has an annular shape with a central opening through which light from the light source 114 may pass. The mounting frame 116 may be made of any suitable rigid material, such as, but not limited to metal, plastic, ceramic, composite material, or combinations thereof.

The mounting frame 116 abuts a portion of the light source 114 (such as, but not limited to, a portion of a circuit board on which one or more LEDs or other light sources are mounted), and clamps the light source (or circuit board) between the mounting frame 116 and the light-source mounting surface of the heat sink member 112. One or more fasteners 117 attach and secure the mounting frame 116 to the heat sink member, and also to clamp and hold the light source 114 against the light-source mounting surface of the heat sink member 112. The fasteners 117 may include, but are not limited to screws, bolts or other threaded fasteners, rivets, glue or other adhesive, solder, welds, clamps, friction or press fitted features, combinations thereof, or the like. In particular examples, the one or more fasteners 117 are threaded fasteners that interface with threaded holes in the heat sink member 112, clamps or other mechanisms that allow a user to selectively and repeatedly remove or release and re-install the fasteners 117, to selectively install or remove the light source 114 (e.g., for inspection, replacement or servicing). In certain examples, the mounting frame 116 may include one or more electrically conductive sections or pads separated from each other and other portions of the mounting frame 116 by electrically insulating sections, such that the mounting frame 116 forms part of the electrical circuit that electrically connects the light source to the driver electronics. In such examples, the mounting frame 116 may include one or more electrically conductive pads that align with and contact electrically conductive sections or pads on the circuit board of the light source 114, when the mounting frame 116 abuts and clamps the light source 114 onto the heat sink member 112.

The optic member 118 may be secured to the heat sink member 112 (or to the frame 116 that is secured to the heat sink member 112). In some examples, the optic member 118 connects to the frame 116 with a twist-lock bayonet connection, a screw threading connection, or other connection mechanism that connects by engaging the optic 118 with the frame and twisting the optic 118 in one direction relative to the frame 116, and disconnects the optic from the frame 116 by twisting the optic 118 in the opposite direction relative to the frame. In other examples, other suitable connection or releasable connection mechanisms may be used to connect the optic member 118 connects to the frame 116 or to the heat sink member 112, including but not limited to friction fit, threaded fasteners, clamps or combinations thereof.

The optic member 118 has a lens body through which light may pass. The lens body of the optic member 118 may be made of any suitable material that passes and directs light such as, but not limited to plastic, glass or other ceramic, composite material, or combinations thereof. The optic member 118 has a light entry side (the side facing upward in the orientation of FIG. 5) and a light exit side (the side facing downward in the orientation of FIG. 5). The optic member 118 is configured to receive light from the light source 114 into the light entry side, and to direct light out from the exit side of the optic member 118.

In particular examples, the heat sink member 112, the light source 114, the frame 116 and the optic member 118 may be connected together to form the light engine assembly 110. Then, the light engine assembly 110 is connected (as a single unit) to the second bracket member 136 of the light engine support bracket assembly 130. The heat sink member 112 may be secured and fixed to the second bracket member 136 by one or more connection mechanisms or fasteners such as, but are not limited to bolts, screws, or other threaded fasteners, rivets, glue or other adhesive, solder, welds, clamps, friction or press fitted features, combinations thereof, or the like. In the example in FIG. 5, threaded fasteners are shown, for securing the heat sink member 112 to the second bracket member 136.

When the heat sink member 112 of the light engine assembly 110 is secured to the second bracket member 136, the light exit side of the optic member 118 is aligned with the aligned openings 136*a*, 134*a* and 132*a* in the bracket assembly 130, such that light emitted from the light source 114 is directed through those aligned openings. Also, when the light engine assembly 110 is secured to the bracket assembly 130, and the bracket assembly 130 is in the first position on the base 103 (as shown in FIG. 2), the light exit side of the optic member 118 and the aligned openings 136*a*, 134*a* and 132*a* in the bracket assembly 130 are aligned with the opening 103*a* in the base 103, such that light emitted from the light source 114 and optic member 118 is directed through those aligned openings and into a room or other environment in which the lighting device system 100 is located.

In particular examples, the optic member 118 is configured to focus and direct light in a manner to pass most of the light emitted from the light source 114 through the aligned openings 136*a*, 134*a* and 132*a* in the bracket assembly 130 and opening 103*a* in the base 103. In certain examples, at least some of the light passing through the optic member 118 may be focused by the optic member 118 to one or more focus points along the axis $A_L$, where the light rays may form a cone that expands outward from the focus point(s) to illuminate a larger area than the area of the aligned openings. In certain examples, at least some of the light passing through the optic member 118 is directed along or substantially parallel to the axis $A_L$. In examples in which the bracket assembly 130 allows for rotational adjustment about the axis $A_1$ or pivotal adjustment about the axis $A_2$ (or both rotational and pivotal adjustment), the direction of the axis $A_L$ and, thus, the direction of light emitted from the light source 114 may be adjusted relative to the axes $A_1$ and $A_2$.

In the example in FIGS. 4 and 5, the driver assembly 120 includes driver electronics 122 and a driver support bracket 124 that holds the driver electronics 122. In particular examples as shown in those drawings, the driver electronics 122 may be provided in a module in which the driver electronics are encased or partially encased in a module housing, In addition, the driver electronics 122 may include or be connected to one or more first electrical conductors 123 that are coupled to the one or more electrical connectors 113 for selectively connecting (or releasing) the driver electronics to (or from) the light engine assembly. The driver electronics 122 may also include or be connected to one or more second electrical conductors 125, through one or more second electrical connectors (not shown), to one or more electrical power conductors (not shown) that may be provided in a ceiling, wall or other structure in which the lighting device system 100 is (or is to be) installed. The electrical power conductors (not shown) may be coupled to a suitable power source that can supply electrical power (or electrical power and control signals) to the lighting device system 100.

The driver electronics 122 may be configured to convert power provided from the power source to a suitable power for driving the light source 114. In examples in which the light source is an LED light source, the driver electronics 122 includes one or more LED drivers to convert power from the power source to a power signal suitable to drive the LED light source. In some examples, the driver electronics includes an AC to DC converter. In some examples, the driver or electronics may include a processor to execute instructions stored on memory (e.g., non-transient computer readable media) to process data and/or to control various functions of the lighting device (e.g., temperature, light output, color of light, direction of light, focus of light, and/or the like).

The driver electronics 122 is received and held by the driver support bracket 124. In the example in FIGS. 2-5, the driver support bracket 124 is formed as a housing or partial housing structure that receives and contains at least a portion of the driver electronics 122. In particular examples, the driver support bracket 124 may include one or more fastening mechanisms, such as one or more spring clips 126 to selectively connect the driver electronics to the driver support bracket 124. In other examples, the one or more fastening mechanisms may include but are not limited to one or more screws, bolts or other threaded fasteners, other clips, friction fitting, adhesives, welding, heat staking, combinations thereof, or the like. In particular examples, the one or more fastening mechanisms allow the driver electronics 122 to be selectively received by or removed from the driver support bracket 124, by manually inserting or withdrawing the driver electronics 122 (e.g., as a single electronics module unit) to or from the driver support bracket and associated fastening mechanism(s).

The driver support bracket 124 is attached and fixed to the base plate 132 of the support bracket assembly 130. In the example in FIGS. 2-5, the driver support bracket 124 is attached to the base plate 132, adjacent the opening 132*a* (and adjacent the support bracket assembly 130 over the opening 132*a*). In addition, the driver support bracket 124 is aligned with the opening 132*a* (and the support bracket assembly 130) in the direction of movement of the base plate 132 between the first and second positions. The driver support bracket 124 is arranged on the base plate 132 in a position at which the driver electronics 122 can be reached by a user's hand, through the opening 103*a* in the base 103, when the bracket assembly 130 is in the second position (FIG. 3). In particular examples, the base plate 132 or the driver support bracket 124 (or both) may include a slot, opening, notch, protrusion or other feature (represented by the slot shaped opening 132*c* in the base plate 132 and the corresponding opening 124*a* in the driver support bracket 124. When the driver support bracket 124 is connected to the base plate 132, the openings 124*a* and 132*c* align with each other and provide an edge that can be engaged by a user's finger or by a tool, to move (slide) the base plate 132 between the first and second positions. In those examples, the aligned openings 124*a* and 132*c* may be visible or accessible (or both), through the opening 103*a* in the base 103, when the base plate 132 is in the second position, as shown in FIGS. 3 and 7*b*.

The lighting device system 100 may be assembled in a factory or manufacturing facility, an assembly facility or at an installation site. In particular examples, the light engine assembly 110 of the system 100 may be assembled by connecting the frame 116 to the heat sink member 112, with the light source 114 clamped therebetween. Electrical connections of the light source 114 to the conductors 113 is made. The optic 118 may be secured to the heat sink member 110 or to the frame 116 by a suitable connection mechanism. The assembled light engine assembly 110 may be attached to the second bracket member of the light engine support bracket assembly 130.

In addition, the light engine support bracket assembly 130 is assembled, by connecting the first bracket member 132 to the base plate 130 (for rotation about the axis $A_1$), and by connecting the second bracket member 134 to the first bracket member 132 (for pivotal motion about the axis $A_2$), such as described herein. The driver support bracket 124 is attached to the base plate 132. The driver electronics 122 is clipped into the driver support bracket 124, and is electrically connected to the light source 114, by connecting the electrical conductors 123 and 113 at the connectors 115.

The base plate 132 is mounted to the rails 106 and 108, for sliding movement as described herein. The electrical conductors 125 are fed through the electrical conductor opening of the housing cover 102, such that the connector ends of the electrical conductors 125 are located outside of the housing cover 102 for connection to a power supply cable during installation. In some examples, the housing cover 102 may include one or more access cover plates 102*a* that cover the electrical conductor opening and that define one or more separated conductor openings, through which separate conductors may be fed (where two openings shown are in FIG. 4, including one opening for input power or control signal conductors and one for output or pass-through power or control signal conductors, e.g., to another lighting system). In those examples, the one or more access cover plates 102*a* may be selectively removable by a user, to access conductors in the housing 102. The housing cover 102 may be secured to the base 103. The order in which the above-described parts are attached and connected may be the order as presented above, or any other suitable order.

The lighting device system 100 may be installed in a recess within a ceiling, wall or other object, at an installation site. To install the lighting device system 100, the connector end of the electrical conductor 125 is electrically connected to a power supply conductor at the installation site (such as, but not limited to, a power conductor located in the plenum space, attic space, inner wall space or other space within a ceiling, wall or other structure). In addition, the housing base is fitted into a recess (such as, by passing the system 100 through an opening in a ceiling, wall or other object, with the opening 103*a* of the base 103 arranged in alignment with the opening.

In that position, the first and second arms 103*c* and 103*d* are adjusted in length, to abut one or more (or a plurality) of rafters, beams or other structures in the installation environment that are suitable for supporting the lighting device system 100. The abutted arm ends are attached to the abutted support structure by one or more fasteners such as, but not limited to one or more bolts, screws, or other threaded fasteners, adhesive, clamps, friction or press fitted features, combinations thereof, or the like, to secure the base 103 in the ceiling, wall or other object.

In the installed state, portions of the bracket assembly 130 (i.e., the base plate 132 or the first bracket member 134) are viewable and accessible through the opening 103*a* in the base 103. In certain examples, the opening 103*a* (and the opening in the ceiling, wall or other object) is large enough for a typical user's hand or fingers of a hand to fit through and engage the base plate 132 or the first bracket member 134. By engaging the bracket assembly 130, the user may apply a force to the bracket assembly 130 (in the sliding or moving direction of the bracket assembly), to move the assembly between first and second positions (as shown in FIGS. 2 and 3, respectively).

Figure 7A:
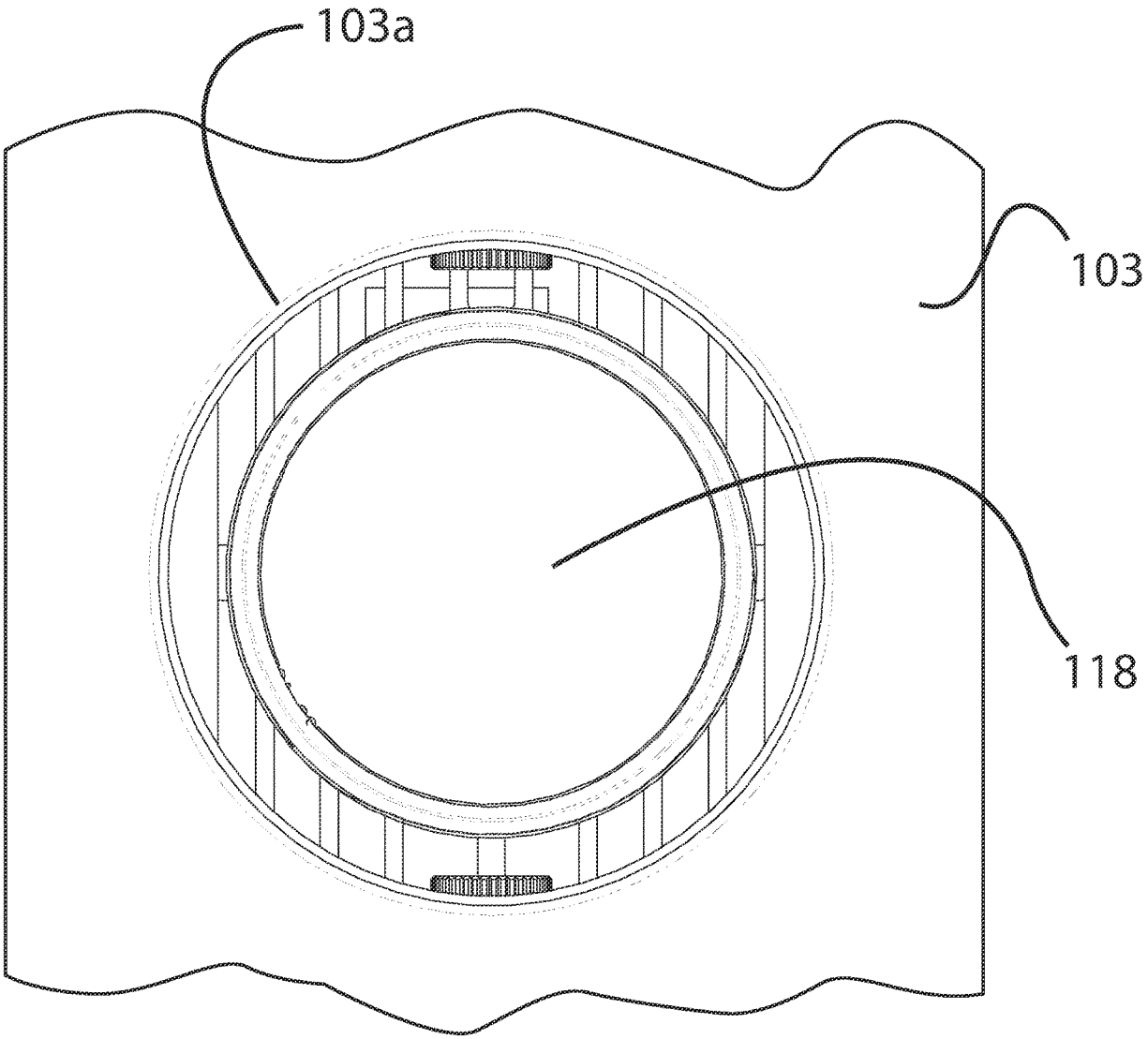
FIGS. 7*a* and 7*b* are bottom views of the lighting device system of FIGS. 1-5, with the lighting device assembly shown in first and second positions, respectively.
Figure 7B:
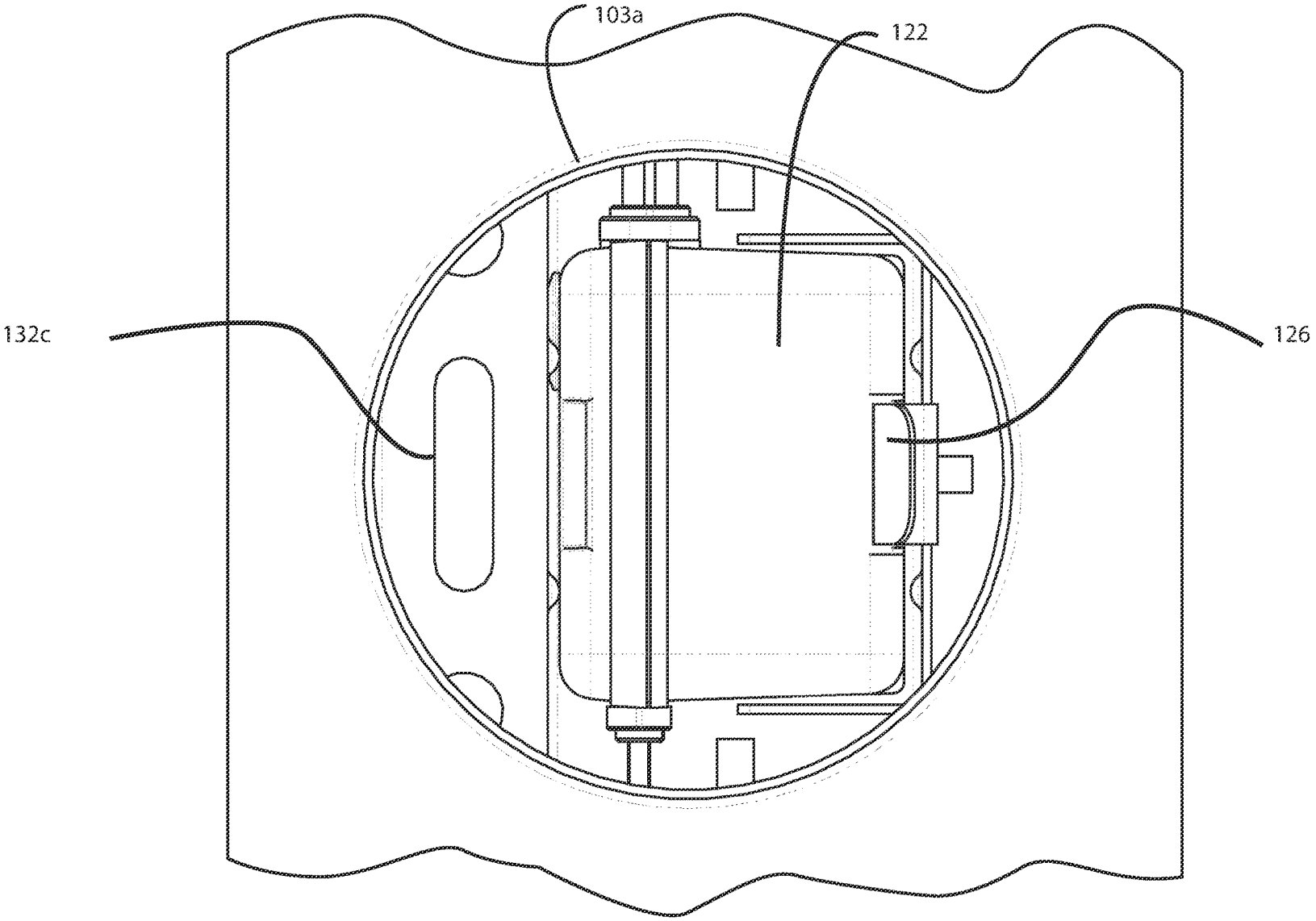

In the first position of the bracket assembly 130 (as shown in FIG. 2), the optic 118 of the light engine assembly 110 is aligned with the opening 103*a* of the base 103 (as shown in FIG. 7*a*). In that first position, the lighting device system may be operated to emit light through the opening 103*a*. In certain examples, when the bracket assembly 130 is in the first position, one or more parts of the light engine assembly 110 is viewable through the opening 103*a* or accessible (reachable) by a user's hand, fingers or a tool through the opening 103*a* (e.g., for inspection, replacement or servicing). In certain examples, the user may apply a manual force on the optic member to move and adjust the optic 118 (and the light engine assembly 110) for rotational adjustment about the axis $A_1$ or pivotal adjustment about the axis $A_2$ (or both rotational and pivotal adjustment), to adjust the direction of the axis $A_L$ and, thus, the direction of light emitted from the light source 114 relative to the axes $A_1$ and $A_2$.

In the second position of the bracket assembly 130 (as shown in FIG. 3), the driver assembly 120 is aligned with the opening 103*a* of the base 103 (as shown in FIG. 7*b*). When the bracket assembly 130 is in the second position, one or more parts of the driver assembly 120 is accessible (reachable) by a user's hand, fingers or a tool, through the opening 103*a* (e.g., for inspection, replacement or servicing). In the example in FIG. 7*b*, the spring clip 126 that holds the driver electronics module 122 in the driver support bracket 124 is accessible (reachable) through the opening 103*a*, to allow a user to selectively release the driver electronics module 122 from the driver support bracket 124 for removal through the opening 103*a* (e.g., for inspection, replacement or servicing).

In various examples described herein, certain components are described as having a round shape, cup shape, square shape, rectangular shape, or cylindrical shaped portions, including, but not limited to the housing cover 102, the base 103, the heat sink member 112, the base plate 132 and the bracket members 134 and 136. However, in other examples, those components may have other suitable shapes including, but not limited to shapes having polygonal or other circular or non-circular cross-sections or combinations thereof.

The foregoing description of illustrative embodiments has been presented for purposes of illustration and of description. It is not intended to be exhaustive or limiting, and modifications and variations may be possible in light of the above teachings or may be acquired from practice of the disclosed embodiments. Various modifications and changes that come within the meaning and range of equivalency of the claims are intended to be within the scope of the invention. Thus, while certain embodiments of the present invention have been illustrated and described, it is understood by those of ordinary skill in the art that certain modifications and changes can be made to the described embodiments without departing from the spirit and scope of the present invention as defined by the following claims, and equivalents thereof.

What is claimed is:

1. A lighting device system comprising:

a lighting device assembly having a light source for generating light;

driver electronics connected to provide one or both of a power signal or a control signal to the light source;

a base having a light opening;

a light engine support bracket assembly movably secured to the base and configured to support the lighting device assembly and the driver electronics, for movement relative to the base between a first position in which an optic or a light source of the light engine assembly is aligned with the light opening of the base to direct light through the light opening, and a second position in which the driver electronics is aligned with the light opening of the base.

2. The lighting device system of claim 1, wherein the base has at least one guide rail to which the light engine support bracket assembly is slidably connected.

3. The lighting device system of claim 1, wherein light engine support bracket assembly is moveably secured to the base for movement in a linear direction on the base.

4. The lighting device system of claim 1, wherein the light engine support bracket assembly comprises a sliding base plate and at least one of a pivotal or a rotatable support structure to which the light engine assembly is attached for at least one of pivotal or rotational adjustment movement relative to the sliding base plate.

5. The lighting device system of claim 1, further comprising at least one releasable lock member for releasably locking the light engine support bracket assembly in one of the first and the second positions.

6. The lighting device system of claim 1, wherein the lighting device assembly comprises:

a heat sink member;

a light source attached to and in thermal communication with the heat sink member, the light source arranged to emit light in a first direction.

7. The lighting device system of claim 6, further comprising an adjustable support bracket assembly attached to and supporting the lighting device assembly in an orientation that is pivotally adjustable about a first adjustment axis, to allow adjustment of the first direction about a first adjustment axis.

8. The lighting device system of claim 7, wherein the adjustable support bracket assembly further supports the lighting device assembly in an orientation that is rotationally adjustable about a second adjustment axis, to allow adjustment of the first direction about the second adjustment axis, the second adjustment axis being transverse to the first adjustment axis.

9. The lighting device system of claim 7, wherein the second adjustment axis is perpendicular to the first adjustment axis.

10. The lighting device system of claim 6, further comprising an adjustable support bracket assembly attached to and supporting the lighting device assembly in an orientation that is rotationally adjustable about an adjustment axis, to allow adjustment of the first direction about the adjustment axis.

11. The lighting device system of claim 1, further comprising a driver support bracket attached to the light engine support bracket assembly for movement with the light engine support bracket assembly, wherein the driver electronics comprises a driver electronics module that is received and held by the driver support bracket.

12. The lighting device system of claim 11, wherein the driver support bracket includes a releasable clip that is accessible through the light opening of the base when the light engine support bracket assembly is in the second position.

13. The lighting device system of claim 1, further comprising:

a housing cover secured to the base and enclosing the lighting device assembly and the driver electronics, the housing cover having one or more openings; and one or more access cover plates that are selectively secured to and removable from the housing cover over the one or more openings in the housing cover.

14. The lighting device system of claim 1, wherein the lighting device assembly includes a selectively removable and attachable optic that is arranged to pass light from the light source.

15. A moveable mount for supporting a lighting device assembly and driver electronics, the moveable mount comprising:

a base having a light opening;

a light engine support bracket assembly movably secured to the base and configured to support the lighting device assembly and the driver electronics, for movement relative to the base between a first position in which an optic or a light source of the light engine assembly is aligned with the light opening of the base to direct light through the light opening, and a second position in which the driver electronics is aligned with the light opening of the base.

16. The moveable mount of claim 15, further comprising a housing cover secured to the base and enclosing the lighting device assembly and the driver electronics.

17. The moveable mount of claim 15, further comprising one or more access cover plates that are selectively secured to and removable from the housing cover over one or more openings in the housing cover.

18. The moveable mount of claim 15, further comprising at least one adjustable arm secured to the base, for mounting the base to a structure.

19. The moveable mount of claim 18, wherein the at least one adjustable arm has a length dimension and is adjustable in length along the length dimension.

20. The moveable mount of claim 15, wherein the base has at least one guide rail to which the light engine support bracket assembly is slidably connected.

21. The moveable mount of claim 15, wherein light engine support bracket assembly is moveably secured to the base for movement in a linear direction on the base.

22. The moveable mount of claim 15, wherein the light engine support bracket assembly comprises a sliding base plate and at least one of a pivotal or a rotatable support structure configured to support the lighting device assembly for at least one of pivotal or rotational adjustment movement relative to the sliding base plate.

23. The moveable mount of claim 15, wherein the lighting device assembly includes a selectively removable and attachable optic that is arranged to pass light from the light source.

24. The moveable mount of claim 15, wherein the light engine support bracket has an opening, notch or protrusion that is engageable through the light opening of the base when the light engine support bracket assembly is in the second position, to selectively apply a force onto the light engine support bracket assembly for moving the light engine support bracket assembly toward the first position.

25. A method of making a lighting device system, the method comprising:

providing a lighting device assembly having a light source for generating light;

connecting driver electronics to the light source to provide one or both of a power signal or a control signal to the light source;

providing a base having a light opening;

supporting the lighting device assembly and the driver electronics by a light engine support bracket assembly;

moveably securing the light engine support bracket assembly to the base for movement relative to the base between a first position in which an optic or a light source of the lighting device assembly is aligned with the light opening of the base to direct light through the light opening, and a second position in which the driver electronics is aligned with the light opening of the base.

* * * * *